US010513012B2

(12) United States Patent
Womack

(10) Patent No.: US 10,513,012 B2
(45) Date of Patent: Dec. 24, 2019

(54) ADJUSTABLE SOCKET

(71) Applicant: Brett Womack, San Francisco, CA (US)

(72) Inventor: Brett Womack, San Francisco, CA (US)

( * ) Notice: Subject to any disclaimer, the term of this patent is extended or adjusted under 35 U.S.C. 154(b) by 251 days.

(21) Appl. No.: 15/430,553

(22) Filed: Feb. 13, 2017

(65) Prior Publication Data

US 2018/0229348 A1 Aug. 16, 2018

(51) Int. Cl.
*B25B 13/44* (2006.01)
*B25B 13/18* (2006.01)

(52) U.S. Cl.
CPC ..... *B25B 13/44* (2013.01); *B25B 13/18* (2013.01)

(58) Field of Classification Search
CPC ..... B25B 13/18; B25B 13/44; B25B 13/463; B25B 13/16; B25B 13/14
USPC ..... 81/128, 90.2, 90.3
See application file for complete search history.

(56) References Cited

U.S. PATENT DOCUMENTS

| | | | | |
|---|---|---|---|---|
| 877,773 | A | 1/1908 | Holm | |
| 1,503,635 | A | 8/1924 | Butler | |
| 2,580,247 | A | 12/1951 | Harrison | |
| 2,742,297 | A | 4/1956 | Bilz | |
| 2,778,260 | A | 1/1957 | Jovanovich | |
| 2,884,826 | A | 5/1959 | Bruhn | |
| 3,209,624 | A | 10/1965 | Shiftman | |
| 3,664,213 | A | 5/1972 | Anati | |
| 3,724,299 | A | 4/1973 | Nelson | |
| 4,378,714 | A | 4/1983 | Colvin | |
| 4,454,657 | A * | 6/1984 | Yasumi | B21C 3/06 29/751 |
| 4,663,999 | A | 5/1987 | Colvin | |
| 5,207,129 | A | 5/1993 | Fossella | |
| 5,337,634 | A | 8/1994 | Carnesi | |
| 5,740,704 | A | 4/1998 | Payne | |
| 5,768,961 | A | 6/1998 | Frawley | |
| 5,791,209 | A | 8/1998 | Marks | |
| 5,819,607 | A | 10/1998 | Carnesi | |
| 5,918,511 | A | 7/1999 | Sabbaghian et al. | |
| 5,996,446 | A | 12/1999 | Lee | |
| 6,073,522 | A | 6/2000 | Carnesi | |
| 6,889,579 | B1 | 5/2005 | Brown | |
| 6,971,284 | B2 | 12/2005 | Owoc | |
| 7,062,996 | B2 | 6/2006 | Johnson | |
| 7,261,021 | B1 | 8/2007 | Carnesi | |
| 7,290,467 | B2 | 11/2007 | Harker | |
| 7,707,916 | B2 | 5/2010 | Pirseyedi | |

(Continued)

*Primary Examiner* — Joshua T Kennedy

(57) ABSTRACT

An adjustable socket including a housing designed on a longitudinal axis, with a series of grooves extending longitudinally along the interior wall. A disc with drive channels intruding obliquely off-center from the perimeter is locked into position within the housing. Jaw members with drive rods are mounted in the disc drive channels, free to move laterally along fixed paths. An axially rotatable drive core with a drive surface is positioned within the housing, engaging the drive rod of each jaw. Rotation of the drive core forces the jaws to travel inwardly along the disc drive channels as dictated by the drive elements of the drive surface, to be forced against a fastener within the jaws. A locking mechanism holds the jaws in position on the fastener. Release of the locking mechanism allows rotation of the drive core in the opposite direction to release the fastener.

2 Claims, 12 Drawing Sheets

(56) References Cited

U.S. PATENT DOCUMENTS

| | | | | |
|---|---|---|---|---|
| 7,946,200 | B2 | 5/2011 | Chang | |
| 7,992,470 | B2 | 8/2011 | Brown | |
| 8,424,422 | B2 * | 4/2013 | Liang | B25B 13/065 81/128 |
| 8,893,592 | B2 | 11/2014 | Womack | |
| 9,174,327 | B1 * | 11/2015 | Christensen | B25B 23/0007 |
| 9,634,451 | B2 * | 4/2017 | Battenfeld | H01R 43/042 |
| 2017/0095908 | A1 * | 4/2017 | Elmi | B25B 7/14 |

* cited by examiner

ADJUSTABLE SOCKET

BACKGROUND OF THE INVENTION

An adjustable socket that can fit varying sizes of fasteners (nuts, bolts, etc.) can replace several fixed-size sockets, reducing the components of a socket set into a minimal number of tools. An adjustable socket allows for streamlining of workflow, as time is no longer spent finding and selecting the correct fixed-size socket from a set. An adjustable socket may also more tightly grip a damaged or worn fastener than a fixed-size socket.

Several adjustable sockets exist in the prior art which are manually adjustable to fit varying sizes of fasteners, by means of a plurality of jaws which are moveable along a fixed path. However, despite the basic functionality of these devices, they are susceptible to inherent design restrictions that limit their effectiveness and range of operation.

The operating range of an adjustable socket with jaws whose pathways travel in a direct radial path toward the fastener is inherently limited. To allow for a wider direct radial contraction of jaws on the head of a fastener, these devices must either have a limited number of jaws, or jaws much narrower than the faces they are intended to grip. These conditions result in decreased shared surface area between the sockets and fasteners, which results in reduced force potential and increased slippage.

In U.S. Pat. No. 8,893,592, there is disclosed an adjustable socket that is manually operable by means of a drive core, which moves jaw members along fixed paths oblique to the center of the socket, and is locked in place by a biased indexing collar. Although this socket allows a user to grip hexagonal fasteners of a wide range of sizes, the features designed to restrict unwanted movement of the jaws are not sufficient, and the drive interface between drive core and jaws restricts the range of available locking sizes for the unit.

BRIEF SUMMARY OF THE INVENTION

An adjustable socket with jaws that travel along paths oblique to the center of the socket can overcome the limitations presented by adjustable sockets with radially-moveable jaws. These oblique pathways can be longer than a corresponding radial pathway, thereby increasing the operable range of the socket. Jaws that travel along oblique pathways may slide past one another rather than contract together, allowing for a jaw of maximum possible width. This in turn creates more shared surface area between socket and fastener, increasing force potential and reducing slippage.

A well-designed adjustable socket is a simple, convenient, cost-effective alternative to a socket set, allowing for a wide range of adjustable sizes, providing the ability to apply and maintain significant force to a fastener without slipping or failing, while maintaining a sleek, aesthetic design. These qualities are included in the embodiments of the adjustable socket described below.

BRIEF DESCRIPTION OF THE SEVERAL VIEWS OF THE DRAWING

The preferred embodiments of the adjustable socket are illustrated by the following figures of the drawings. These figures and the illustrated embodiments therein are intended to be exemplary and not restrictive.

DETAILED DESCRIPTION OF THE INVENTION

Figure 1:
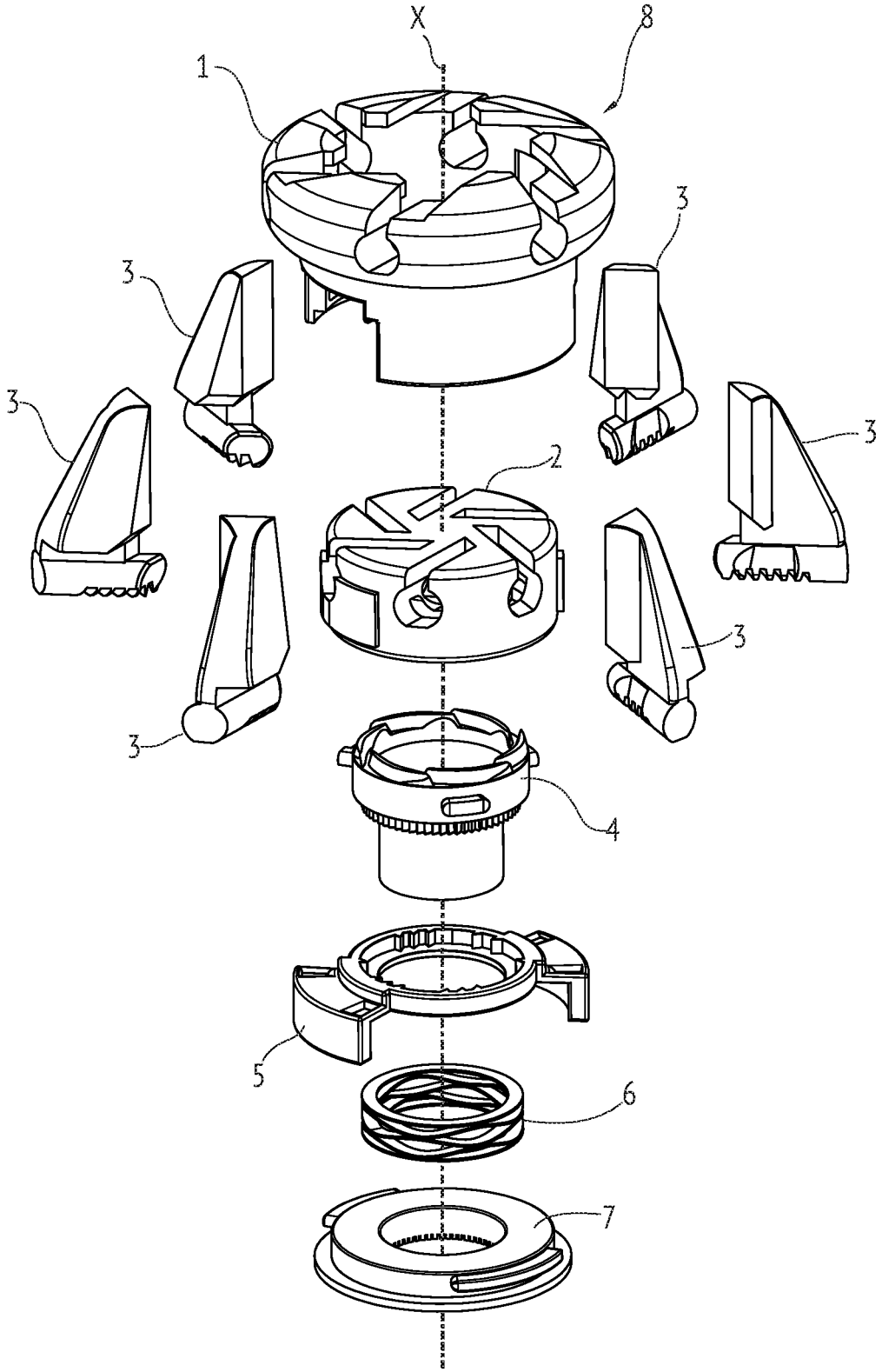
FIG. 1 is an exploded oblique view of an adjustable socket.

The following description contains concise, exact details to provide any person skilled in the art a clear and thorough understanding of the instrument described herein. Well-known elements may not be described in detail, however, to avoid unnecessary complication of the description and associated illustrations. Furthermore, the described embodiments and associated illustrations are intended to be exemplary and not restrictive, as modifications or refinements to the preferred embodiments may occur.

FIGS. 1 and 2A-2D depict an adjustable socket 8 comprising a housing 1, a disc 2, a plurality of jaws 3, a drive core 4, an indexing collar 5, a wave spring 6, and a retaining plug 7.

Figure 3A:
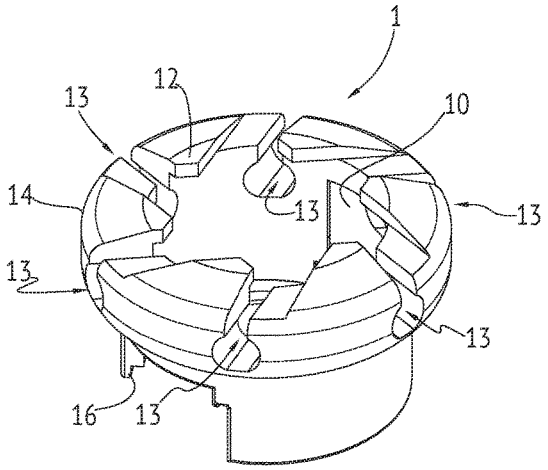
FIGS. 3A, 3B, and 3C are respectively oblique top front, oblique bottom front, and front elevation views of the FIG. 1 adjustable socket's housing.
Figure 3C:
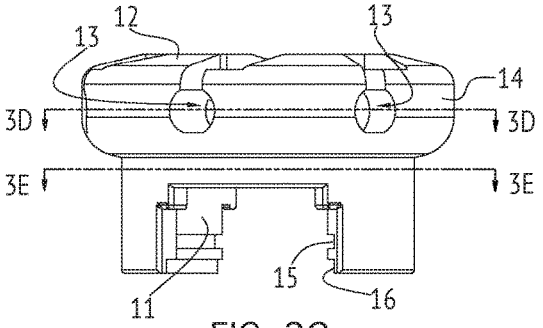
Figure 3B:
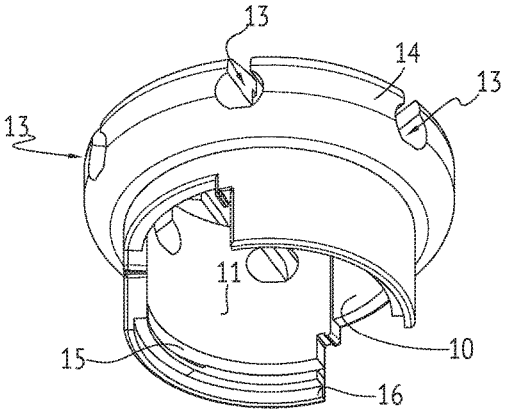
Figure 3D:
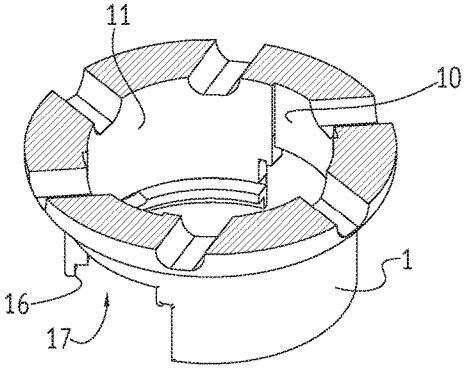
FIGS. 3D and 3E are cross-sectional oblique top front views taken with respect to lines 3D-3D and 3E-3E respectively shown in FIG. 3C.
Figure 3E:
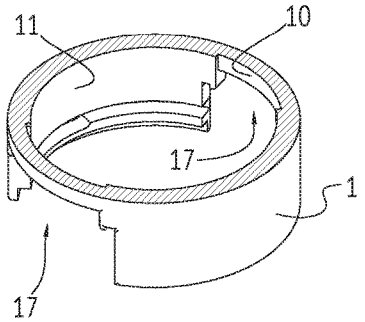

Housing 1 (also shown separately in FIGS. 3A-3C) is generally circular in cross-section, and possesses a generally cylindrical internal shape aligned along a longitudinal axis X. Two vertical locking grooves 10, sized and shaped to couple with disc 2, extend longitudinally along an interior housing wall 11, terminating at a distance from a top housing lip 12. Support channels 13 installed through an exterior housing wall 14 are sized and shaped to accept moveable jaws 3. Locking slots 15 are installed in the interior housing wall 11 which, along with a bottom housing lip 16, are sized and shaped to couple with retaining plug 7. Two longitudinal apertures 17 installed in exterior housing wall 14 are adapted to accept an indexing collar 5 which, when assembled with a wave spring 6 and retaining plug 7, is biased toward the top housing lip 12 of housing 1.

Figure 4A:
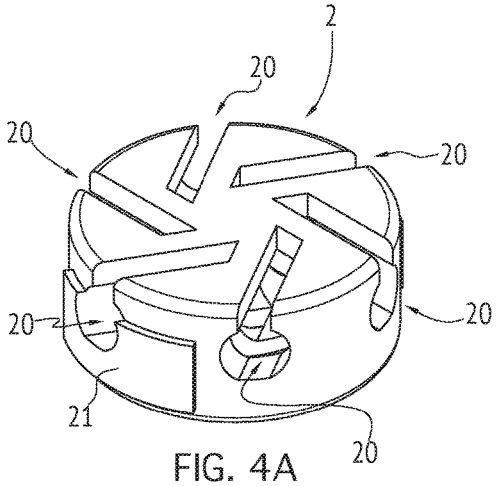
FIGS. 4A, 4B, and 4C are respectively oblique top front, oblique bottom front, and front transparent elevation views of the FIG. 1 adjustable socket's disc.
Figure 4D:
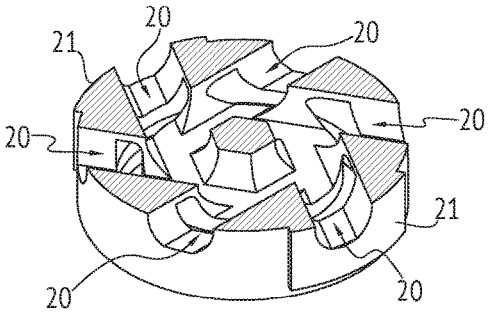
FIGS. 4D, 4E, and 4F are cross-sectional oblique top front views taken with respect to lines 4D-4D, 4E-4E, and 4F-4F respectively shown in FIG. 4C.
Figure 4B:
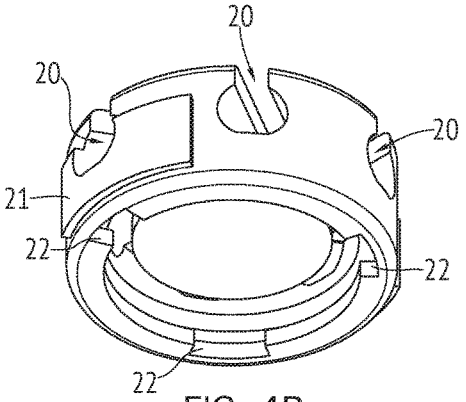
Figure 4E:
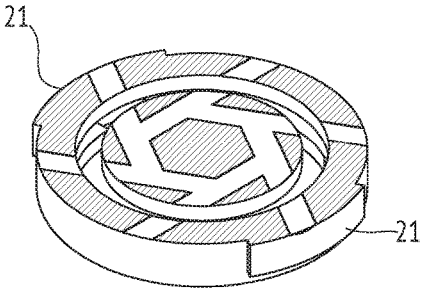
Figure 4C:
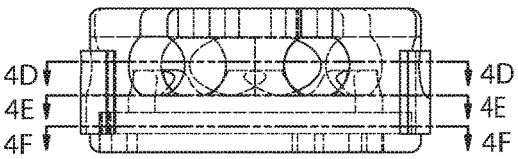
Figure 4F:
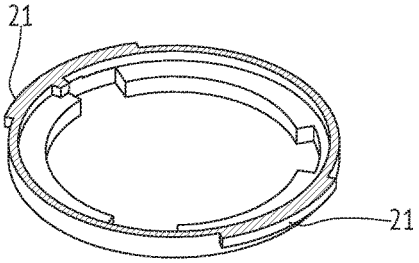
Figure 5A:
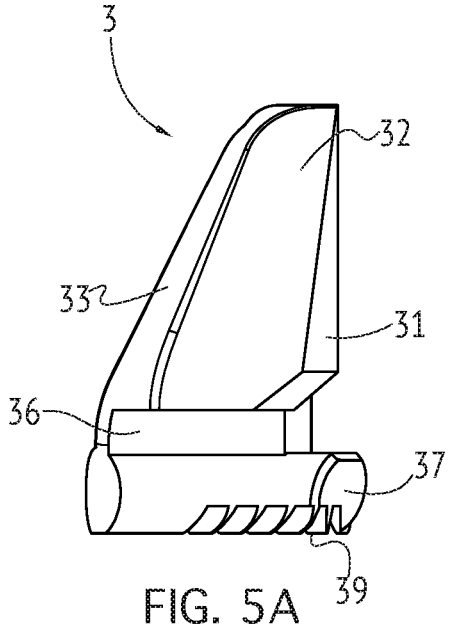
FIGS. 5A, 5B, 5C, 5D, and 5E are respectively side elevation, bottom plan, oblique bottom rear, oblique bottom front, and oblique bottom rear views of one of the FIG. 1 adjustable socket's jaws.
Figure 5D:
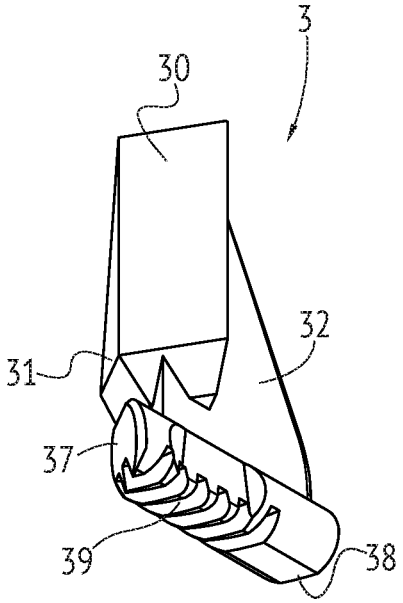
Figure 5B:
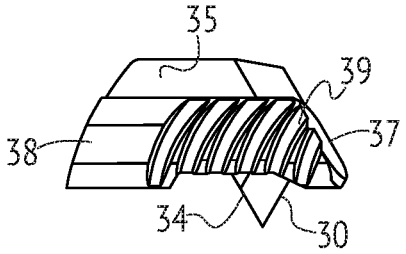
Figure 5E:
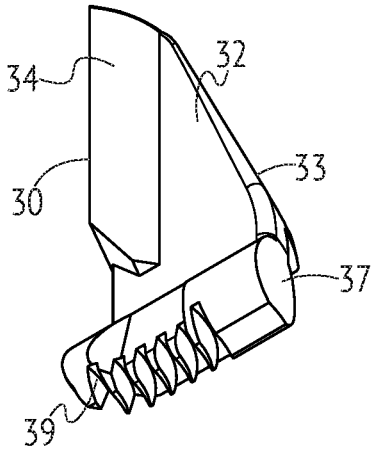
Figure 5C:
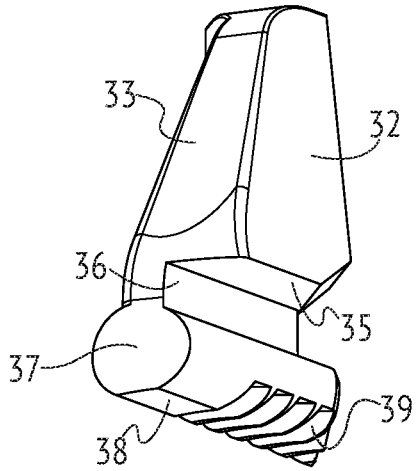

Disc 2 (also shown separately in FIGS. 4A-4C) is generally circular in cross-section with a series of six oblique horizontal drive channels 20, open to the perimeter and angled at approximately a 60 degree differential from the adjacent drive channels. Locking tabs 21 extend out radially from the perimeter of disc 2, to allow for coupling with the locking grooves 10 of housing 1. Three locking slots 22 installed through a bottom lip 23 are sized and shaped to accept a drive core 4.

Each jaw 3 (one of which is shown separately in FIGS. 5A-5E) has a flat inward face 30, a flat beveled face 31, two flat side faces 32, a convex outward face 33, a flat flare face 34, and a flat bottom face 35. For the purpose of this description, "inward" means facing toward axis X, and "outward" means facing away from axis X as shown in FIG. 1. Extending downward from flat bottom face 35 is a stem 36, connected to a generally cylindrical horizontal drive rod 37. Drive rod 37 has a flat bottom face 38, within which tapered grooves 39 extend upward toward stem 36.

Stem 36 and drive rod 37 are sized and shaped to fit snugly within the drive channels 20 of disc 2, and to restrict rotation of jaw 3 within drive channel 20 relative to axis X. Bottom faces 35 and 38 are sized and shaped to restrict vertical motion or tilting of jaw 3 within drive channel 20 relative to axis X. The aforementioned motion restrictions allow jaw 3 to move laterally through drive channel 20 while not excessively tilting or rotating relative to axis X.

Drive core 4 (also shown separately in FIGS. 6A-6D) is generally circular in cross-section with a top drive surface 40 at a right angle to axis X, comprising six spiraling drive fins 41 each sized and shaped to be accepted by a tapered groove 39 of jaw 3. Extending downward from surface 40 is a series of teeth 42 sized and shaped to be coupled with indexing collar 5. Extending downward from teeth 42 is a generally cylindrical drive shaft 43 extending down to a lower drive core lip 44, within the bottom of which is drive aperture 45, sized and shaped to accept a ratcheting socket-driving tool 81 with ½ inch drive element 82 (shown in FIGS. 11A-11E). A sizing notch 46 is etched into lower drive core lip 44. Three locking tabs 47 extend outward from an outer wall 48, and are sized and shaped to be accepted by the locking slots 22 of disc 2.

Figure 2B:
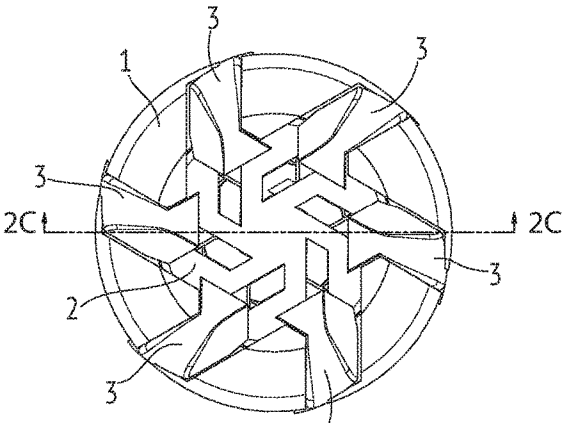
FIG. 2B is a top view of the FIG. 1 adjustable socket.
Figure 2D:
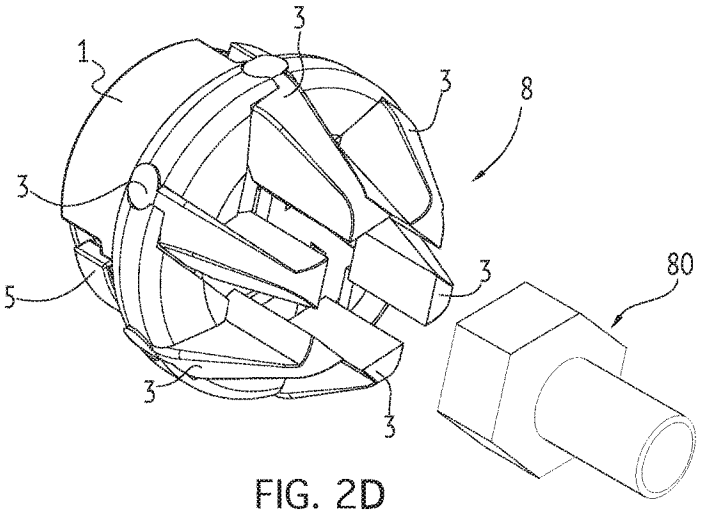
FIG. 2D is an oblique top side view of the FIG. 1 adjustable socket, with a fastener shown schematically.
Figure 2A:
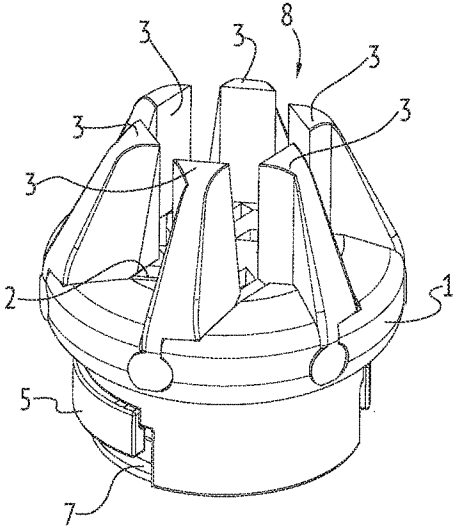
FIG. 2A is an oblique top front view of the FIG. 1 adjustable socket.
Figure 2C:
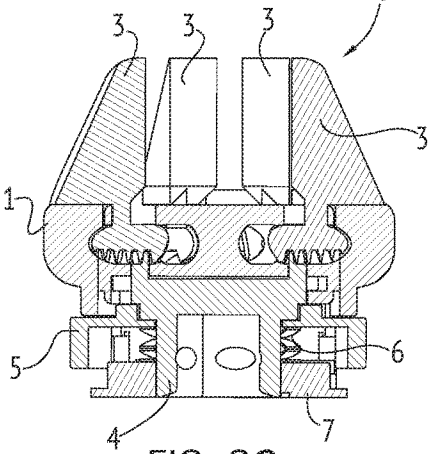
FIG. 2C is a cross-sectional view taken with respect to line 2C-2C shown in FIG. 2B.

FIGS. 7A-7D illustrate the partial assembly of adjustable socket 8, comprising disc 2, six jaws 3, and drive core 4. Inserting one jaw 3 into each drive channel 20 of disc 2 results in three pairs of diametrically-opposed jaws 3, which create in their center a hexagonal shape to allow for acceptance of a standard hexagonal fastener 80 as depicted in FIG. 2D. Drive core 4 is coupled with jaws 3, so that each drive fin 41 is inserted into a separate tapered groove 39 of a jaw 3.

It is understood that for the purposes of clearly illustrating the drive action of the partial assembly depicted in FIGS. 7A-7D that housing 1 is not depicted, but that its presence would hold disc 2 in the fixed position shown. It is also understood that the partial assembly depicted in FIGS. 7A-7D would be held together by the coupling of housing 1 to retaining plug 7, which is also not depicted for the sake of clarity.

As drive core 4 is rotated in the direction shown by arrow 90 (FIG. 7A), the drive fins 41 of drive core 4 engage the tapered gooves 39 of jaws 3, contracting them into the center of drive core 4 toward axis X (shown in FIG. 1). The jaws 3 are forced to travel along the path prescribed by drive channels 20, due to being locked into the pathway by stem 36 and drive rod 37, which prevent vertical motion or tilting of jaw 3 within drive channel 20 relative to axis X. The angles of inward faces 30 and flare faces 34 are sized and shaped to allow jaws 3 to slide past one another during operation of the mechanism without touching or dragging, while holding inward faces 30 in fixed position to one another and parallel to the corresponding faces of a fastener within jaws 3. A jaw 3 may travel inwardly along drive channel 20 until beveled face 31 meets side face 32, at which point the smallest possible hexagonal shape is achieved.

FIGS. 8A-8D are top plan views of the FIG. 1 adjustable socket's drive mechanism, corresponding to the positions of the drive mechanism as depicted in FIGS. 7A-7D, illustrating the combined motions of jaws 3 in relation to one another. It is understood that for the purposes of clearly illustrating the drive action of the partial assembly depicted in FIGS. 8A-8D that housing 1 is not depicted, but that its presence would hold disc 2 in the fixed position shown. It is also understood that the partial assembly depicted in FIGS. 8A-8D would be held together by the mating of housing 1 to retaining plug 7, which is also not depicted for the sake of clarity. As drive core 4 is rotated in the direction shown by arrow 91 (FIG. 8A), the drive fins 41 of drive core 4 engage the tapered gooves 39 of jaws 3, contracting them into the center of drive core 4 toward axis X (shown in FIG. 1). The jaws 3 are forced to travel along the paths prescribed by drive channels 20.

An indexing collar 5 is shown in FIGS. 9A-9D, comprising a collar ring 50 with a series of teeth 51 along the interior ring wall 52, sized and shaped to couple with drive core 4. Two asymmetrical tabs 53 are sized and shaped to allow insertion of indexing collar 5 into apertures 17 of housing 1, which maintains fixed axial position of the indexing collar while the drive mechanism is operated. Two handles 54 allow for manual operation of the locking mechanism.

Figure 6A:
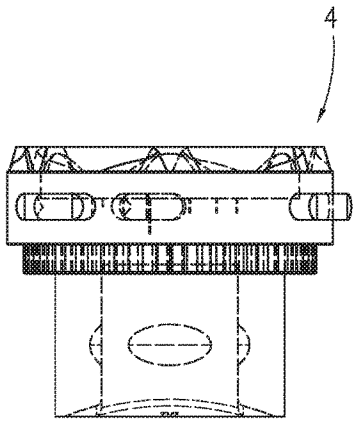
FIGS. 6A, 6B, 6C, and 6D are respectively front transparent elevation, oblique top front, top plan, and oblique bottom front views of the FIG. 1 adjustable socket's drive core.
Figure 6B:
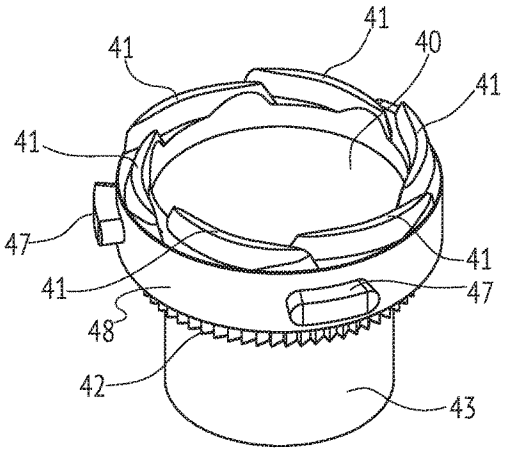
Figure 6C:
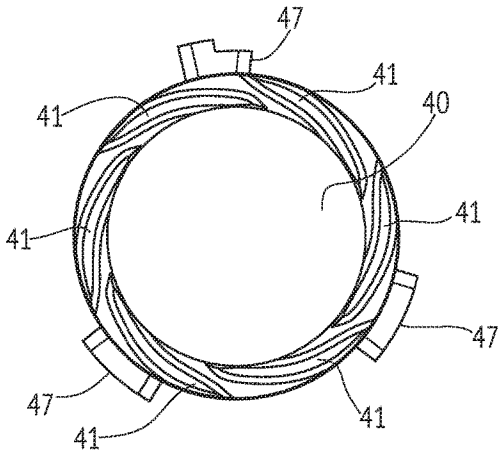
Figure 6D:
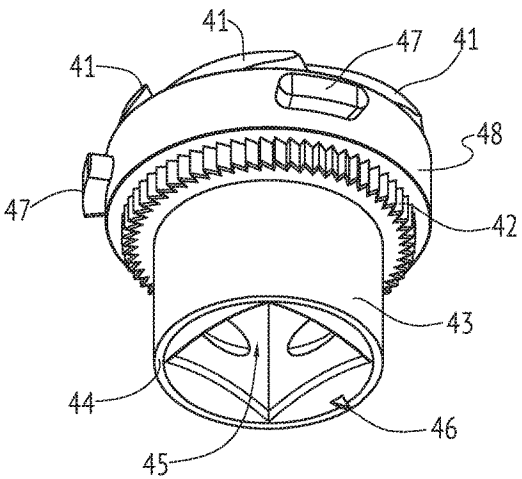
Figure 7A:
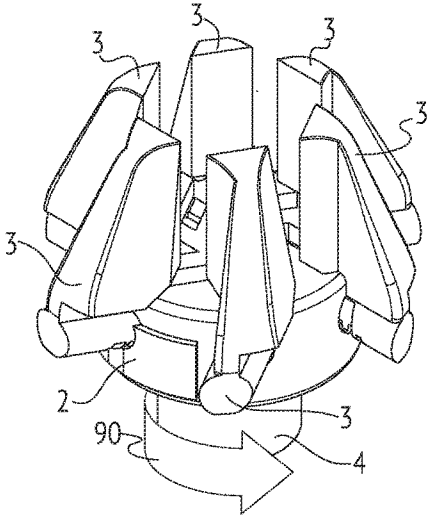
FIG. 7A is an oblique top front view of the FIG. 1 adjustable socket's drive mechanism with jaws fully opened, and an arrow depicting the motion of the drive core.
Figure 7B:
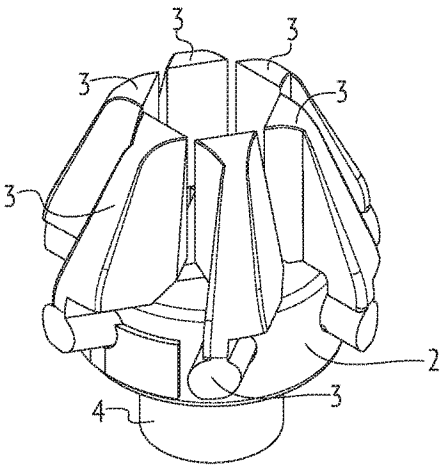
FIGS. 7B, 7C, and 7D are oblique top front views of the FIG. 1 adjustable socket's drive mechanism, illustrating varying positions of the tightening jaws as the drive core is rotated.
Figure 7C:
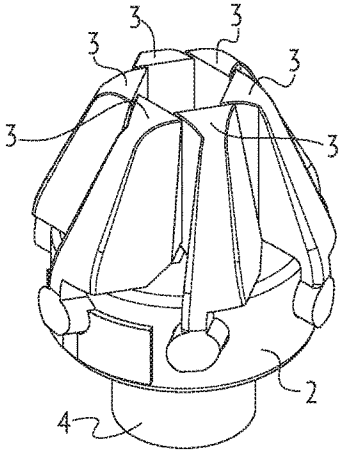
Figure 7D:
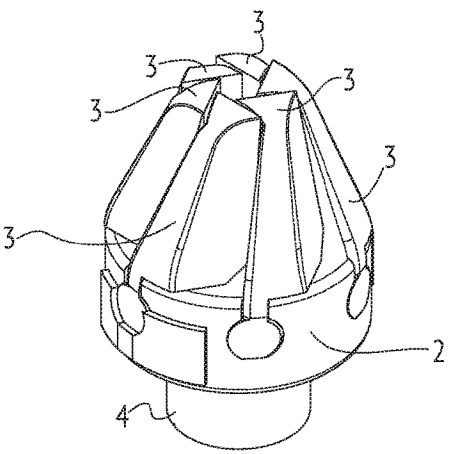
Figure 8A:
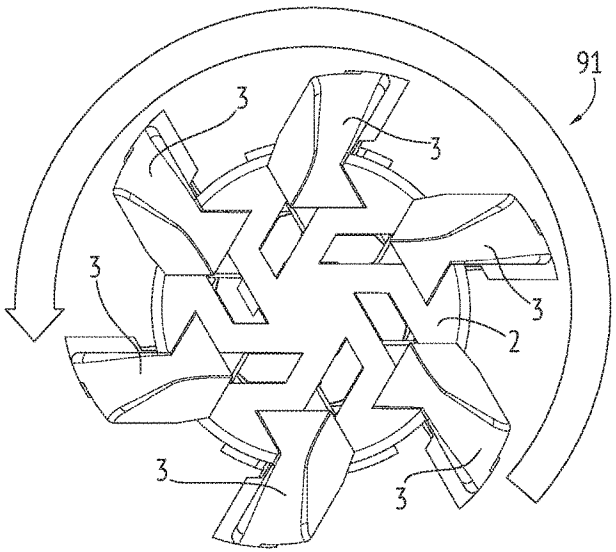
FIG. 8A is a top view of the FIG. 1 adjustable socket's drive mechanism with jaws fully opened, with an arrow depicting the motion of the drive core.
Figure 8B:
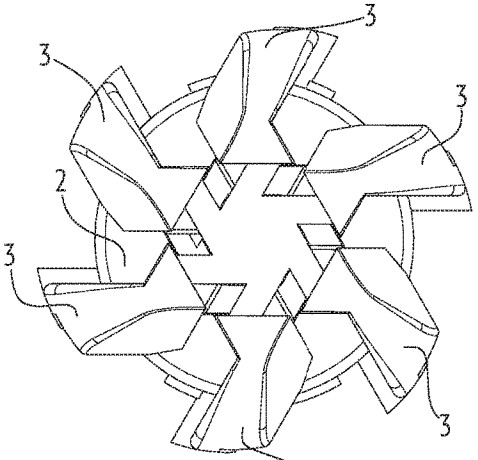
FIGS. 8B, 8C, and 8D are top views of the FIG. 1 adjustable socket's drive mechanism, illustrating varying positions of the tightening jaws as the drive core is rotated.
Figure 8C:
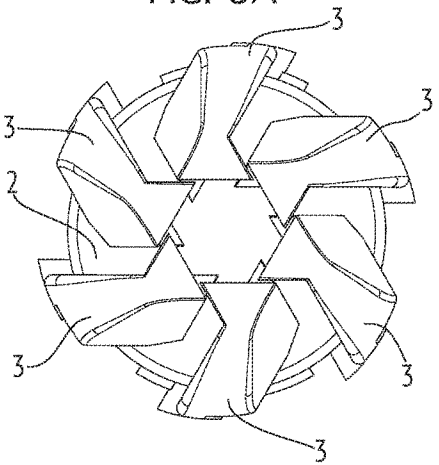
Figure 8D:
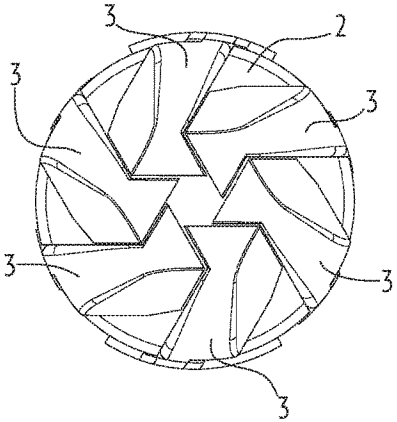
Figure 9B:
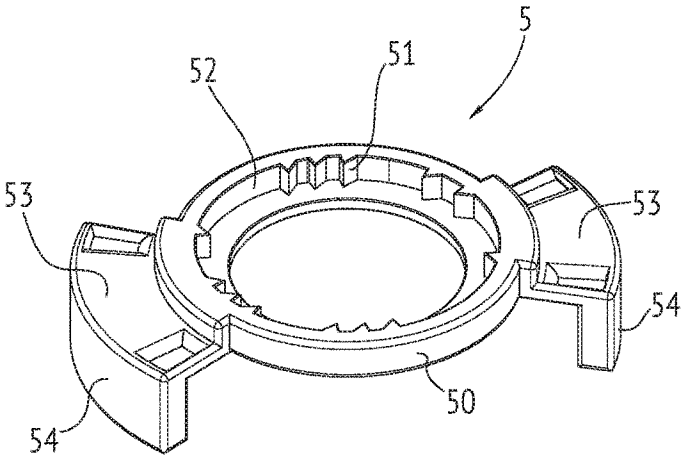
FIGS. 9A, 9B, 9C, and 9D are respectively top plan, oblique top front, front elevation, and oblique bottom front views of the FIG. 1 adjustable socket's indexing collar.
Figure 9D:
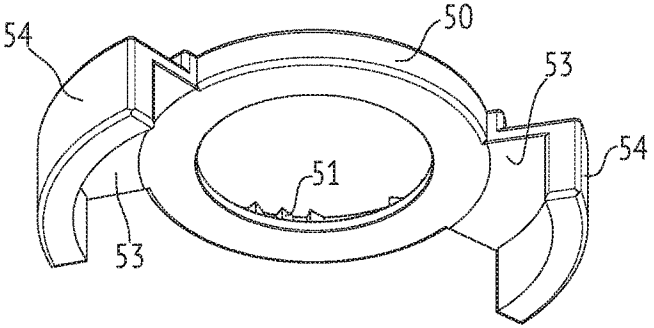
Figure 9A:
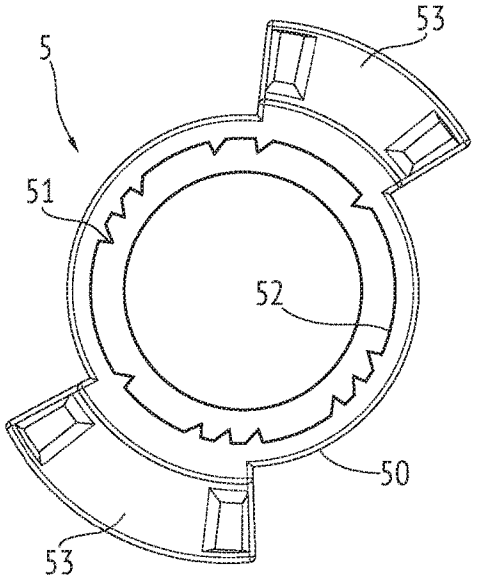
Figure 9C:
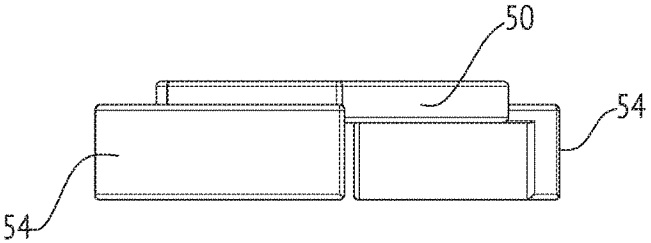
Figure 10B:
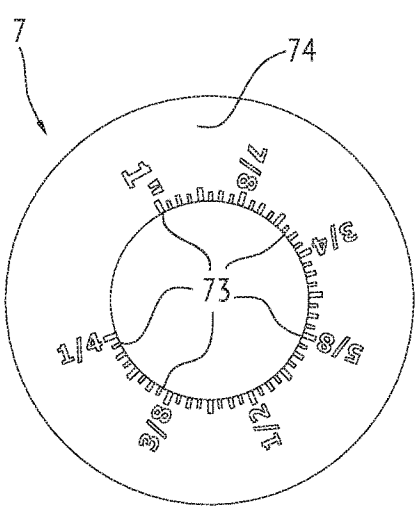
FIGS. 10A, 10B, 10C, and 10D are respectively top plan, bottom plan, oblique top front, and oblique bottom front views of the FIG. 1 adjustable socket's retaining plug.
Figure 10A:
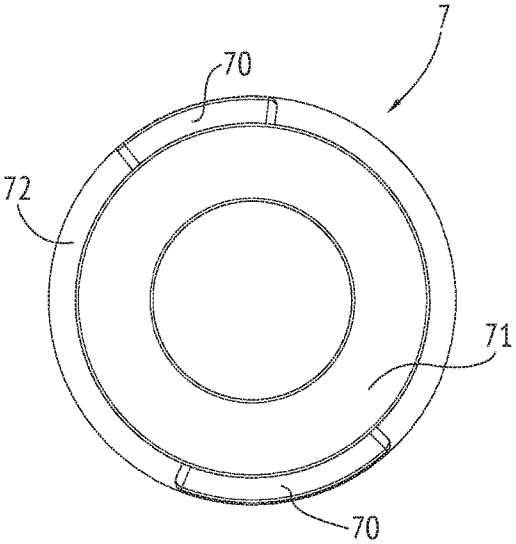
Figure 10D:
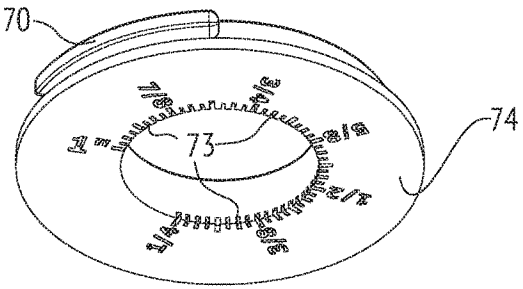
Figure 10C:
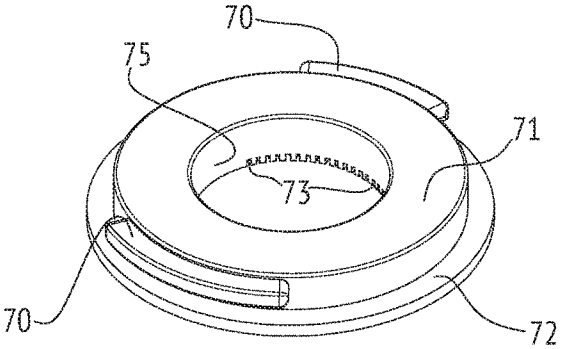

Retaining plug 7 (FIGS. 10A-10D) is generally cylindrical in shape, with two locking tabs 70 extending between a top face 71 and outer lip 72, sized and shaped to couple with the locking slots 15 of housing 1. A series of sizing indicators 73 are etched into a bottom face 74, skirting the edge of an interior face 75. When retaining plug 7 is completely locked into housing 1, outer lip 72 is sized to enter into housing 1 so that bottom face 74 couples flush with bottom housing lip 16 (FIG. 3A) and lower drive core lip 44 (FIG. 6D). As drive core 4 is rotated the direction shown by arrow 91 (FIG. 8A), a sizing notch 46 (FIG. 6D) moves along sizing indicators 73, indicating the size of fastener that jaws 3 are currently in position to accept. This process is best illustrated by FIGS. 12D and 13D.

Figure 11A:
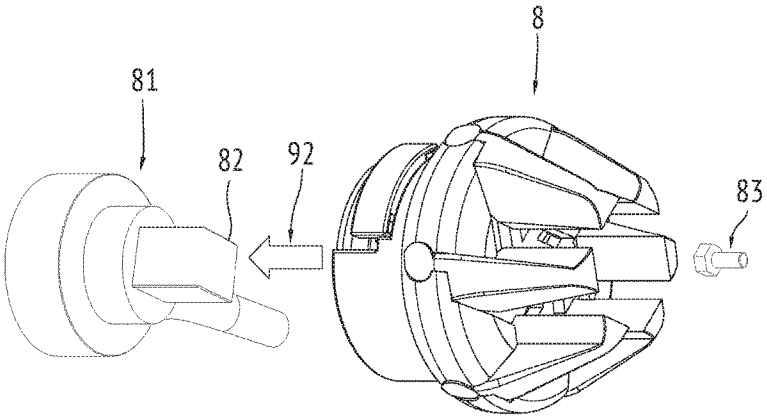
FIGS. 11A and 11B are respectively oblique side exploded and oblique side views showing the FIG. 1 adjustable socket coupling with a half-inch ratcheting socket-driving tool.
Figure 11B:
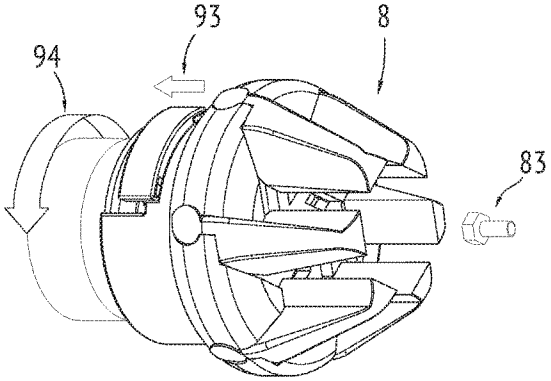
Figure 11C:
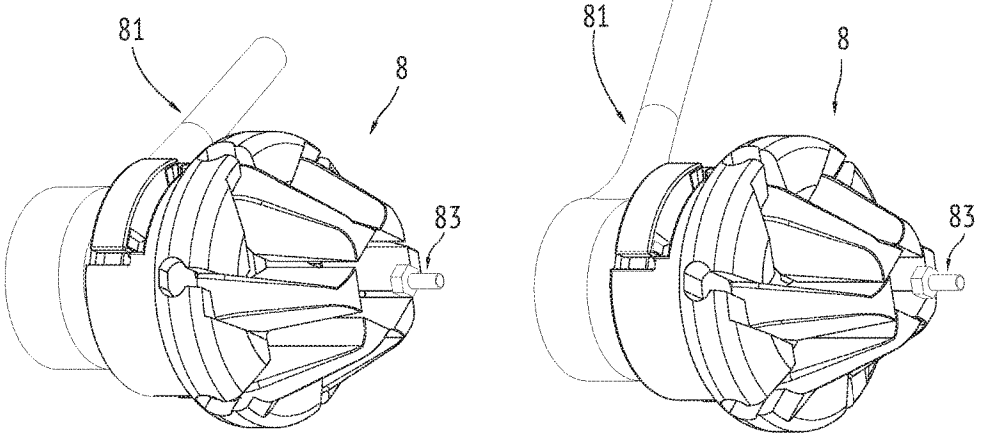
FIGS. 11C, 11D, and 11E are oblique side views depicting the FIG. 1 adjustable socket's jaws tightening on a schematically-shown fastener, as the ratcheting socket-driving tool is rotated in the direction indicated by the arrow in FIG. 11B.
Figure 11D:
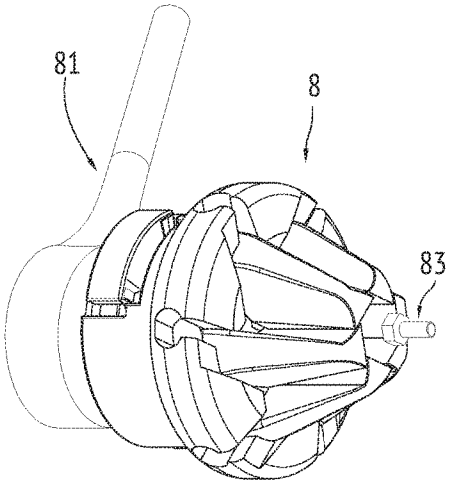
Figure 11E:
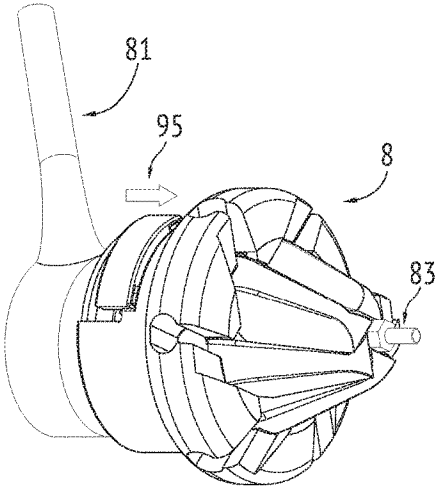

FIG. 11A illustrates adjustable socket 8 being affixed to a ratcheting socket-driving tool 81 with ½ inch drive element 82, via the direction indicated by arrow 92. A wave spring 6 (also shown in FIG. 1) is included within housing 1 and held in place by retaining plug 7, to bias indexing collar 5 to a locked position yet allow manual release of drive core 4 when moved in the direction shown by arrow 93 in FIG. 11B, for operation of the adjustable socket 8 drive mechanism. FIGS. 11C-11E illustrate the ratcheting socket-driving tool 81 being rotated in direction 94, and the resultant action of adjustable socket 8 as it tightens down upon a ¼ inch fastener 83. FIG. 11E illustrates the action of indexing collar 5, which is biased by wave spring 6 in the direction illustrated by arrow 95 into a locked position, holding jaws 3 into the fixed position shown.

Figure 12A:
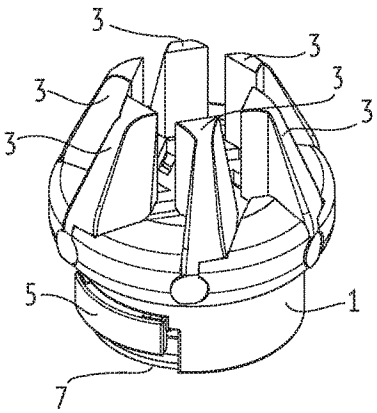
FIGS. 12A, 12B, 12C, and 12D are respectively oblique top front, oblique bottom front, top plan, and bottom plan views of the FIG. 1 adjustable socket, showing the jaws in a fully open position.
Figure 12B:
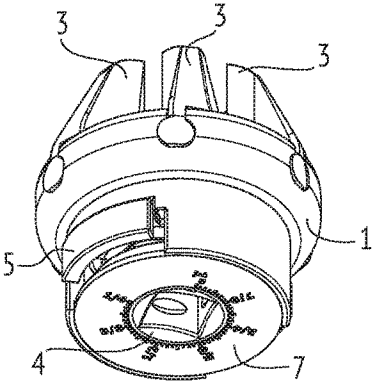
Figure 12C:
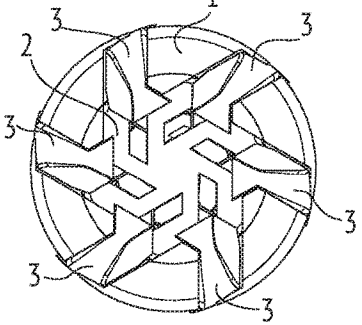
Figure 12D:
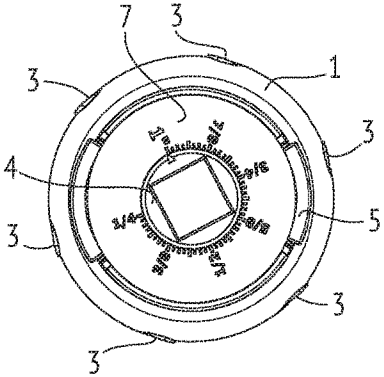

FIGS. 12A-12D show adjustable socket 8 with jaws 3 in a fully open position, spaced to accept a 1 inch fastener as indicated in FIG. 12D.

Figure 13A:
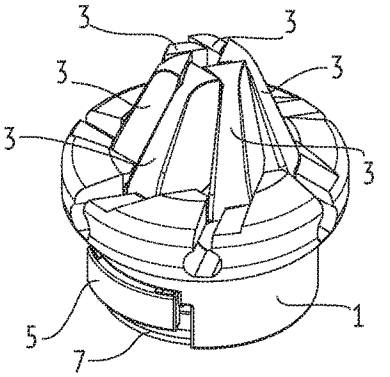
FIGS. 13A, 13B, 13C, and 13D are respectively oblique top front, oblique bottom front, top plan, and bottom plan views of the FIG. 1 adjustable socket, showing the jaws in a fully closed position.
Figure 13B:
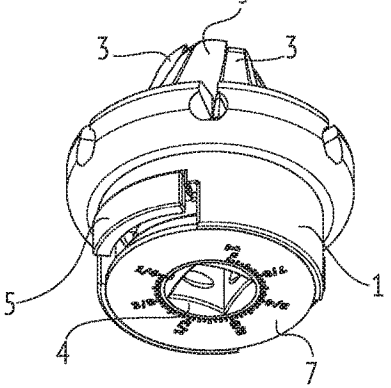
Figure 13C:
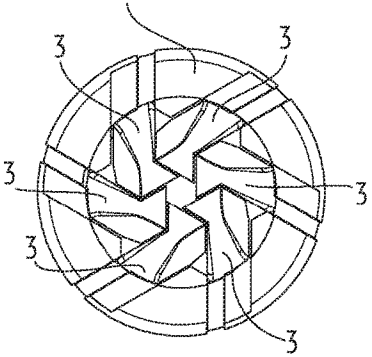
Figure 13D:
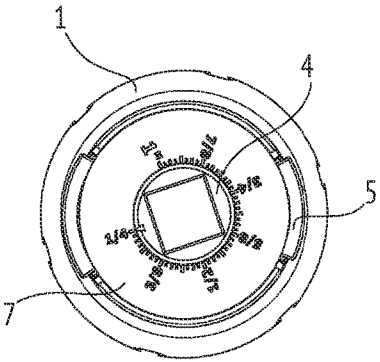

FIGS. 13A-13D show adjustable socket 8 after complete rotation of drive core 4 in the direction shown by arrow 94 (FIG. 11B), drawing jaws 3 inward into a fully closed position, spaced to accept a ¼ inch fastener as indicated in FIG. 13D.

What is claimed is:

1. An adjustable socket having a plurality of selectable socket size openings, comprising:

a. a housing, generally cylindrical in cross-section aligned along a longitudinal axis, comprising:
   i. a top housing lip; and
   ii. a bottom housing lip; and
   iii. an interior housing wall; and
   iv. a plurality of locking grooves extending longitudinally along the interior housing wall; and b. a disc, generally circular in cross-section and having a circular perimeter, the disc comprising:
   i. a plurality of drive channels:
      1. open to the perimeter; and
      2. angled obliquely off-center; and
   ii. a plurality of locking tabs extending out radially from the perimeter, sized and shaped to couple with the locking grooves of the housing; and c. a plurality of jaw members, sized and shaped to move laterally within the disc drive channels, and wherein rotation, vertical motion, and tilting of the jaws, relative to a center longitudinal axis of the housing, remains fixed, each jaw member comprising:
   i. a flat shaped inward face, facing toward the longitudinal axis of the housing; and
   ii. a flat flare face, angled to allow adjacent jaw members to slide past one another during operation of the mechanism; and
   iii. a drive rod sized and shaped to couple with the disc and a drive core; and
   iv. two flat shaped side faces; and
   v. a flat shaped bottom face; and
   vi. a convex shaped outward face, facing away from the center longitudinal axis of the housing; and
   vii. a stem, extending downward from the flat bottom face; and
   viii. a drive rod with a plurality of tapered grooves; and d. a drive core, generally circular in cross-section and axially rotatable within the housing, comprising:
   i. a top drive surface at a right angle to the longitudinal axis of the housing, with drive elements sized and shaped to be accepted by the drive rod of each jaw member; and
   ii. wherein rotation of the drive core within the housing forces the jaw members to travel inwardly or outwardly along the disc drive channels as dictated by the drive elements; and
   iii. a series of teeth extending downward from the drive surface; and
   iv. a drive shaft extending downward from the teeth; and e. a locking mechanism that locks the drive core and jaws into different positions corresponding to various socket size openings; and f. a retaining plug, sized and shaped to couple with the housing bottom, containing the drive mechanism within the housing, and allowing for the drive shaft to accept a drive element.

2. The adjustable socket of claim 1, wherein the drive core further comprises:

a. the top drive surface at a right angle to the longitudinal axis of the housing, with six drive fins sized and shaped to be accepted by the tapered grooves of each jaw member's drive rod; and b. wherein rotation of the drive core within the housing forces the jaw members to travel inwardly along the disc drive channels as dictated by the drive fins, and the inward faces of the jaw members are forced against corresponding faces of a fastener located within the jaw members; and c. a series of teeth extending downward from the drive surface, sized and shaped to be engaged by a locking mechanism; and d. a generally cylindrical drive shaft extending downward from the teeth; and e. a drive aperture within the bottom of the drive shaft, adapted to accept a ratcheting socket-driving tool; and f. a sizing notch adapted to indicate the size of fastener the current jaw positions are sized to accept.

* * * * *